US005286619A

United States Patent [19]

Tsuji

[11] Patent Number: 5,286,619

[45] Date of Patent: Feb. 15, 1994

[54] SILVER HALIDE PHOTOGRAPHIC LIGHT-SENSITIVE MATERIAL

[75] Inventor: Nobuaki Tsuji, Hino, Japan

[73] Assignee: Konica Corporation, Tokyo, Japan

[21] Appl. No.: 44,952

[22] Filed: Apr. 9, 1993

[30] Foreign Application Priority Data

Apr. 15, 1992 [JP] Japan ..... 3-95539

[51] Int. Cl.[5] ..... G03C 1/76

[52] U.S. Cl. ..... 430/536; 430/9; 430/523; 430/527; 430/529; 430/531

[58] Field of Search ..... 430/523, 9, 11, 527, 430/529, 531, 536

[56] References Cited

U.S. PATENT DOCUMENTS

| | | | |
|---|---|---|---|
| 4,259,576 | 8/1982 | Miyagaka et al. | 430/523 |
| 4,464,462 | 9/1984 | Sugimoto et al. | 430/523 |
| 4,645,735 | 2/1987 | Sugimoto et al. | 430/523 |
| 5,108,884 | 4/1992 | Shibata et al. | 430/523 |

*Primary Examiner*—Jack P. Brammer

*Attorney, Agent, or Firm*—Frishauf, Holtz, Goodman & Woodward

[57] ABSTRACT

A silver halide photographic light-sensitive material excellent in antistatic property and evelopment uniformity is provided, comprising a support having on one side thereof hydrophilic colloidal layers including a silver halide emulsion layer, which is exposed and processed with an automatic processing machine, wherein at least one of the hydrophilic layers contains a water-soluble polymer represented by formula [I] or a water-soluble polymer having a repeating unit represented by formula [II], and a nonionic surfactant represented by formula [IIIa], [IIIb] or [IIIc].

$$\text{-}(A)_n\text{-}(B)_m\text{-}(C)_l\text{-} \quad [I]$$

[II]

$$R_1\text{—}A\text{-}(CH_2CH_2O)_{n1}\text{—}H \quad [IIIa]$$

[IIIb]

[IIIc]

9 Claims, 2 Drawing Sheets

SILVER HALIDE PHOTOGRAPHIC LIGHT-SENSITIVE MATERIAL

FIELD OF THE INVENTION

The present invention relates to a silver halide photographic light-sensitive material and an image forming method, more specifically a silver halide photographic light-sensitive material excellent in antistatic property and development uniformity in processing using an automatic processing machine, and a rapid image forming method thereof.

BACKGROUND OF THE INVENTION

It is known that incorporating a nonionic surfactant in a hydrophilic colloidal layer of a silver halide photographic light-sensitive material is effective in reducing the occurrence of static marks caused by frictional electrification, peeling electrification and other factors.

However, containment of a nonionic surfactant in a hydrophilic colloidal layer on the silver halide emulsion layer side for improving the antistatic property poses a problem of frequent occurrence of uneven development in processing using an automatic processing machine.

Therefore there is a need for a silver halide photographic light-sensitive material excellent in antistatic property and development evenness in processing using an automatic processing machine, and a rapid image forming method.

SUMMARY OF THE INVENTION

The object of the present invention is to provide a silver halide photographic light-sensitive material excellent in antistatic property and development evenness in processing using an automatic processing machine, and a rapid image forming method thereof.

The object of the present invention has been accomplished by:

1) a silver halide photographic light-sensitive material processed using an automatic processing machine, wherein the hydrophilic colloidal layer on the silver halide emulsion layer side contains a water-soluble polymer of the following formula I or at least one water-soluble polymer comprising at least one kind of a repeating unit represented by the following formula II, and at least one of nonionic surfactants of the following formula III, III' or III", More preferred embodiments of the silver halide photographic light-sensitive material is 2) the silver halide photographic light-sensitive material of the above, wherein the degree of surface matting on the silver halide emulsion layer side is not higher than 50 mmHg, and 3) an image forming method using the light-sensitive material of term 1) above, wherein the total processing time is not longer than 50 seconds.

Accordingly, the present inventors found that uneven development occurred in a photographic light-sensitive material containing a nonionic surfactant can be reduced significantly by incorporating at least one kind of the hydrophilic polymer of formula I or of the hydrophilic polymer comprising a repeating unit represented by formula II into the hydrophylic colloidal layer on the silver halide emulsion layer side.

The inventors also found that the effect of the containment of the above compound increases as the degree of surface matting on the silver halide emulsion layer side decreases (not higher than 50 mmHg).

The inventors also found that the effect of the containment of the above compounds increases as the total processing time decreases (not longer than 50 seconds).

Formula [I]

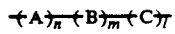

Formula [A]

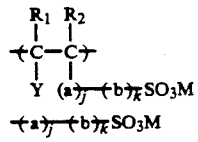

Formula [II]

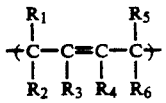

Formula [III]

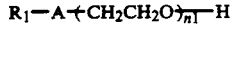

Formula [III']

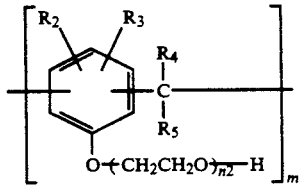

Formula [III"]

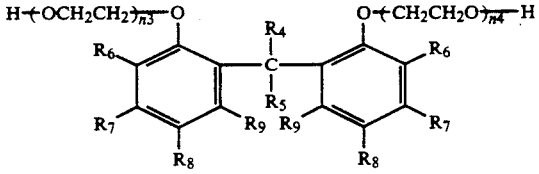

In these formulas, $R_1$ represents a substituted or unsubstituted alkyl group having 1 to 30 carbon atoms, an alkenyl group or an aryl group; A represents an —O— group, an —S— group, a —COO— group, an —N—$R_{10}$ group, a —CO—N—$R_{10}$ group or an —$SO_2$-N—R group ($R_{10}$ represents a hydrogen atom or a substituted or unsubstituted alkyl group).

DETAILED DESCRIPTION OF THE INVENTION

Figure 1:
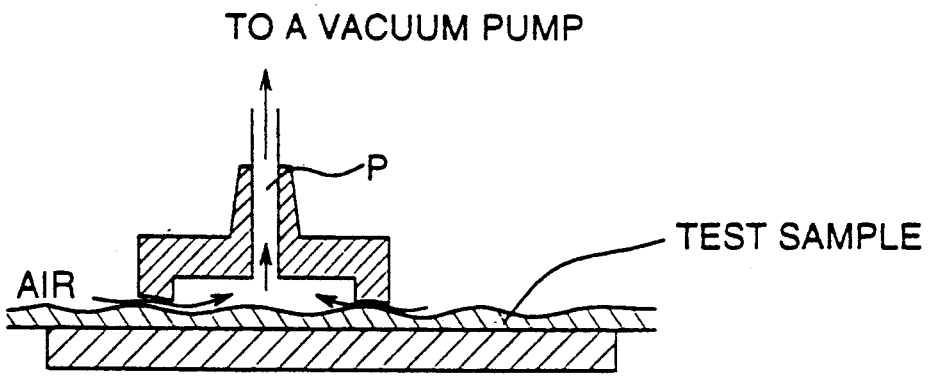
FIG. 1 shows schematically an apparatus for evaluating a mattness.
Figure 2:
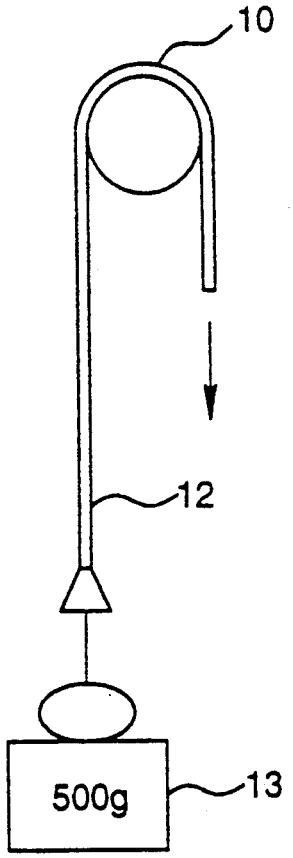
FIG. 2 shows schematically an apparatus for static mark testing.

Water soluble polymers represented by formula I used for the present invention are described below.

Formula [I]

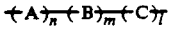

wherein A represents a repeating unit represented by the following formula A; B and C independently represent a repeating unit comprising a vinyl monomer copolymerizable with A. Formula I contains a repeating unit of formula A in an amount of 10 to 100 mol % per polymer molecule. Thus, n is 10 to 100 mol % and m+l is 0 to 90 mol %.

Formula [A]

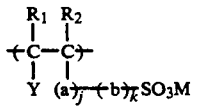

wherein $R_1$ and $R_2$, independently represent a hydrogen atom, an alkyl group, preferably one having 1 to 4 carbon atoms (e.g., methyl group, ethyl group, propyl group, butyl group), including one having a substituent, a halogen atom such as chlorine, or $—CH_2COOM$; a represents —CONH—, —NHCO—, —COO—, —OCO—, —CO—, $—SO_2—$, $>NHSO_2—$, $—SO_2NH—$ or —O—; b represents an alkylene group, preferably one having 1 to 10 carbon atoms (e.g., methylene group, ethylene group, propylene group, trimethylene group, butylene group, hexylene group), including one having a substituent, an arylene group (e.g., phenylene group), including one having a substituent, or an aralkylene group including one having a substituent; M represents a hydrogen atom, an alkali metal atom, an alkaline earth metal atom, an ammonium group or an organic ammonium group; j represents an integer of 0 or 1, and k represent an integer of 1 to 10; Y represents a hydrogen atom or the following:

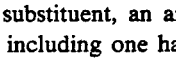

Examples of compounds (water-soluble polymers) represented by formula I are given below, which are not to be construed as limitative.

I-1

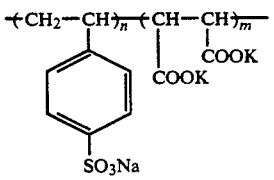

n:m = 50:50
$\overline{M}_n \approx 120,000$

I-2

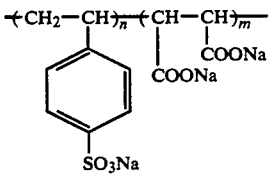

n:m = 70:30
$\overline{M}_n \approx 5,000$

I-3

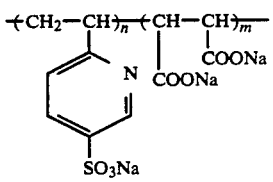

n:m = 80:20
$\overline{M}_n \approx 10,000$

-continued

I-4

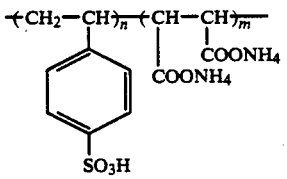

n:m = 20:80
$\overline{M}_n \approx 30,000$

I-5

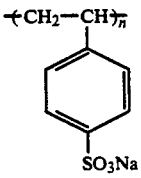

$\overline{M}_n \approx 50,000$

I-6

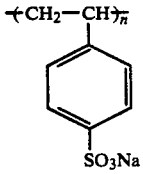

$\overline{M}_n \approx 5,000$

I-7

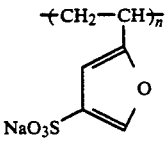

$\overline{M}_n \approx 200,000$

I-8

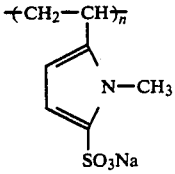

$\overline{M}_n \approx 200,000$

I-9

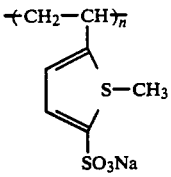

$\overline{M}_n \approx 150,000$

I-10

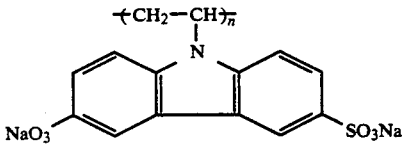

$\overline{M}_n \approx 300,000$

I-11

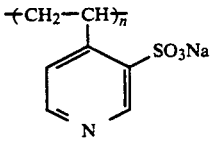

$\overline{M}_n \approx 280,000$

-continued
I-12
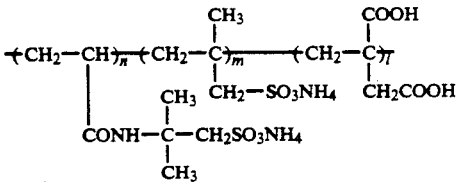
n:m:l = 75:5:20
$\overline{M}_n \approx 5{,}000$
I-13
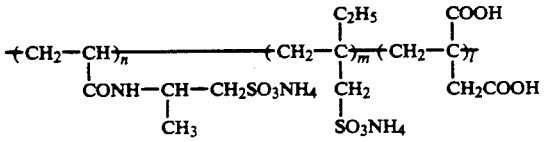
n:m:l = 75:5:20
$\overline{M}_n \approx 50{,}000$
I-14
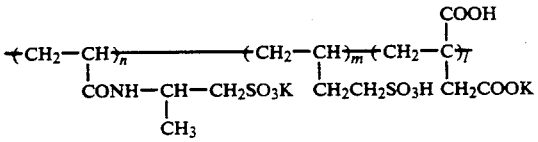
n:m:l = 50:5:45
$\overline{M}_n \approx 120{,}000$
I-15
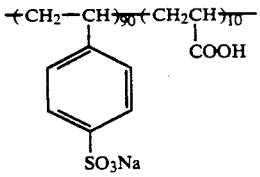
$\overline{M}_n = 10{,}000$
I-16
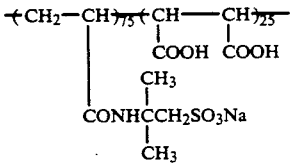
$\overline{M}_n = 6{,}000$
I-17
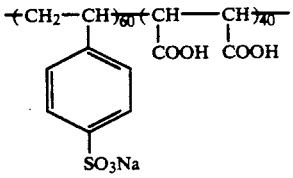
$\overline{M}_n = 6{,}000$
I-18
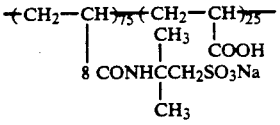
$\overline{M}_n = 6{,}000$
-continued
I-19
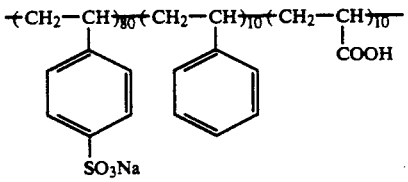
$\overline{M}_n = 15{,}000$
I-20
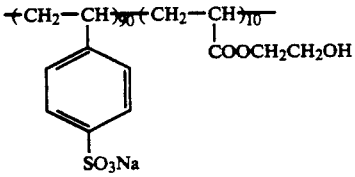
$\overline{M}_n = 10{,}000$
I-21
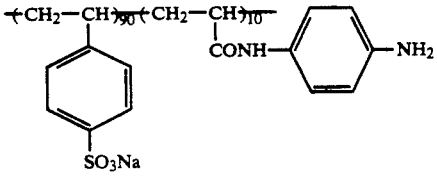
$\overline{M}_n = 15{,}000$
I-22
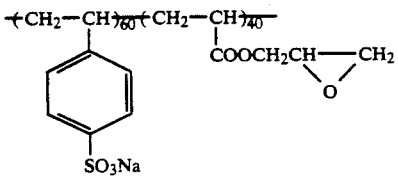
$\overline{M}_n = 6{,}000$
I-23
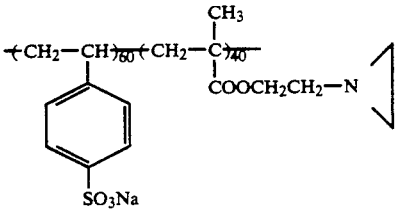
$\overline{M}_n = 8{,}000$
I-24
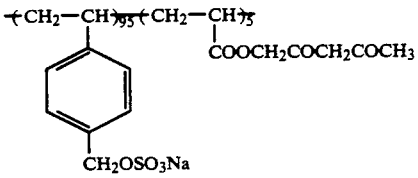
$\overline{M}_n = 25{,}000$
I-25
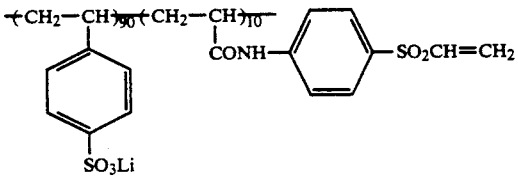
$\overline{M}_n = 6{,}000$ The number-average molecular weight ($\overline{M}_n$) of the water-soluble polymer ranges normally from 500 to 5,000,000, preferably 1,000 to 500,000.

Water-soluble polymers of the present invention, comprising at least one kind of a repeat unit represented by formula II, are described below.

Formula [II]

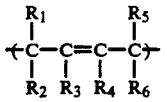

wherein $R_1$ through $R_6$ independently represent a hydrogen atom, an alkyl group having 1 to 8 carbon atoms, an aryl group having 6 to 20 carbon atoms or $-SO_3X$, where X represents a hydrogen atom, an atom of alkali metal, an atom of alkaline earth metal, an ammonium group or an organic ammonium group, and at least one of $R_1$ through $R_6$ is $-SO_3X$.

A compound having a repeat unit of the above formula II, used for the present invention, can be obtained by sulfonating and then polymerizing a diene monomer or by polymerizing a diene monomer and then sulfonating.

With respect to the compound of the present invention, the content of the repeat unit represented by formula II is not less than 10 mol %, preferably not less than 20 mol %.

Examples of diene monomers used for the present invention include 1,3-butadiene, 1,2-butadiene, 1,2-pentadiene, 1,3-pentadiene, 2,3-pentadiene, isoprene, 1,2-hexadiene, 1,3-hexadiene, 1,4-hexadiene, 1,5-hexadiene, 2,3-hexadiene, 2,4-hexadiene, 2,3-dimethyl-1,3-butadiene, 2-ethyl-1,3-butadiene, 1,2-heptadiene, 1,3-heptadiene, 1,4-heptadiene, 1,5-heptadiene, 1,6-heptadiene, 2,3-heptadiene, 2,5-heptadiene, 3,4-heptadiene, 3,5-heptadiene and 2-phenylbutadiene, and also various branched diene monomers.

These diene monomers may be used singly or in combination.

In the above method wherein a diene monomer is sulfonated and then polymerized, the sulfonate can be produced by, for example, sulfonating the diene monomer as described below while retaining the double bond thereof.

Specifically, using sulfur trioxide as a sulfonating agent, a diene monomer can be sulfonated under conventional conditions such as those described in Jikken Kagaku Koza, edited by the Chemical Society of Japan, and Japanese Patent Publication Open to Public Inspection (hereinafter referred to as Japanese Patent O.P.I. Publication) No. 26310/1989.

Although the sulfonate thus obtained is not subject to limitation as to cationic moiety, the cation is preferably hydrogen, alkali metal, alkaline earth metal, ammonium, amine or the like from the viewpoint of water solubility.

Such alkali metals include sodium and potassium. Such amines include alkylamines such as methylamine, ethylamine, propylamine, dimethylamine, diethylamine, triethylamine, butylamine, dibutylamine and tributylamine, polyamines such as ethylenediamine, diethylenetriamine and triethylenetetramine, morpholine and piperidine. Such alkaline earth metals include calcium and magnesium.

These cations may be exchanged with other cations by various ion exchanging techniques.

A compound of the present invention, having a repeat unit represented by the above formula II, may be copolymerized with other monomer copolymerizable with the diene monomer (hereinafter referred to as "other monomers") in not less than 99% by weight, preferably 1 to 98% by weight, and more preferably about 10 to 90% by weight.

Such other copolymerizable monomers include aromatic compounds such as styrene, α-methylstyrene, vinyltoluene and p-methylstyrene, alkyl esters of acrylic or methacrylic acid such as methyl acrylate, ethyl acrylate, butyl acrylate, 2-ethylhexyl acrylate, methyl methacrylate, 2-hydroxyethyl acrylate and 2-hydroxyethyl methacrylate, anhydrides of mono- or dicarboxylic acids such as acrylic acid, methacrylic acid, crotonic acid, maleic acid, fumaric acid and itaconic acid, aliphatic conjugated dienes such as butadiene, isoprene, 2-chloro-1,3-butadiene and 1-chloro-1,3-butadiene, vinyl cyanide compounds such as acrylonitrile and methacrylonitrile, vinyl chloride, vinylidene chloride, vinyl methyl ethyl ketone, vinyl methyl ether, vinyl acetate, vinyl formate, allyl acetate, methallyl acetate, acrylamide, methacrylamide, N-methylolacrylamide, glycidyl acrylate, glycidyl methacrylate, acrolein and allyl alcohol.

Specifically, a sulfonate of the above diene monomer and, where necessary, one or more other monomers copolymerizable therewith are subjected to radical polymerization in the presence of a solvent for polymerization such as water or an organic solvent using a radical polymerization initiator, chain transferring agent and other additives.

The sulfonated polymer thus obtained can have repeat units represented by formulas II' and/or II'', as well as a repeat unit represented by formula II.

The unit represented by formula II' and/or II'' is contained in an amount of 0 to 70 mol %, preferably 0 to 50 mol %. This content can be controlled according to polymerizing conditions.

Formula [II']

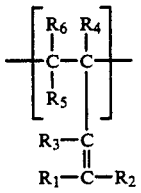

Formula [II'']

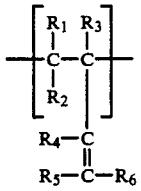

With respect to formulas II' and II'', $R_1$ through $R_6$ are identical to those defined in the above formula II.

Although the weight-average molecular weight (Mw) of the sulfonated polymer thus obtained varies depending on the use thereof, it is normally 500 to 5,000,000, preferably 1,000 to 500,000.

The sulfonated polymer of the present invention may be converted to acid forms or salts of alkali metal, alkaline earth metal, ammonium, amine, etc. by ion exchanging or neutralization.

When the monomer sulfonate is formed prior to polymerization, the sulfonated polymer thus obtained is neutralized in an aqueous alkali solution such as aqueous sodium hydroxide, potassium hydroxide or ammonia to yield a water-soluble or hydrophilic polymer salt wherein at least some of the sulfone groups have formed salt. Although the sulfonate is not subject to limitation as to cation for forming a salt in the sulfone group thereof, the cation is preferably hydrogen atom, alkali metal, alkaline earth metal, ammonium, amine or the like from the viewpoint of water solubility as described above.

These cations may be exchanged mutually with other cations by various ion exchanging techniques.

An aqueous solution of a water-soluble (co)polymer salt is thus prepared.

The degree of sulfone group neutralization can be chosen as appropriate, as long as the (co)polymer salt is soluble or dispersible in water, and sulfone groups may form different salts.

As described above, a (co)polymer of the present invention can be obtained from a sulfonated diene monomer, but alternatively, it can also be obtained by polymerizing and then sulfonating a diene monomer. The (co)polymer may be produced by any of these methods, which are carried out by known procedures.

Examples of compound having a repeat unit represented by formula II of the present invention are given below, which are not to be construed as limitative.

II-1

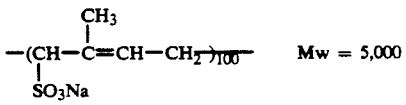

Mw = 5,000

II-2

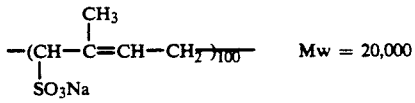

Mw = 20,000

II-3

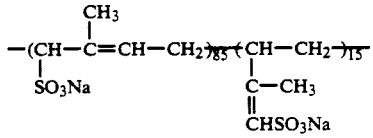

Mw = 20,000

II-4

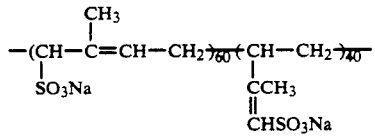

Mw = 40,000

II-5

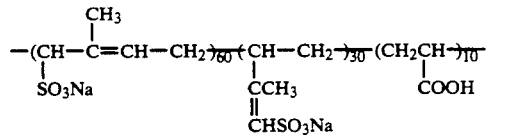

Mw = 30,000

II-6

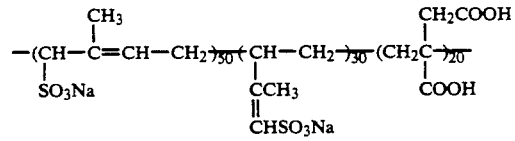

Mw = 10,000

(Constituent proportion: mol %)

II-7

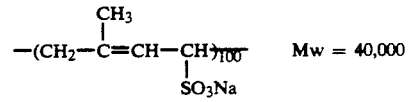

Mw = 40,000

II-8

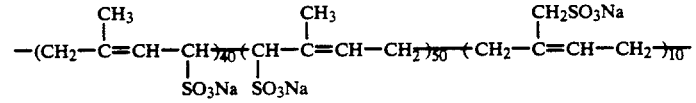

Mw = 40,000

II-9

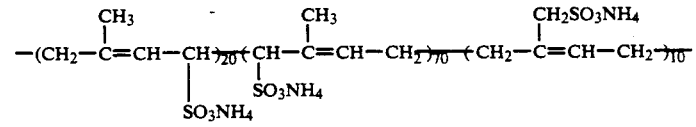

Mw = 40,000

-continued

II-10

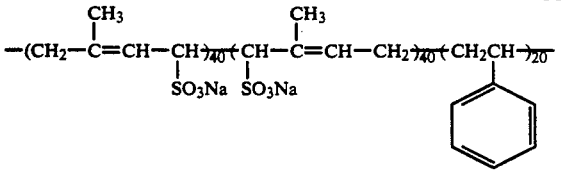

Mw = 40,000

II-11

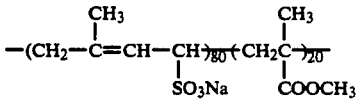

Mw = 10,000

II-12

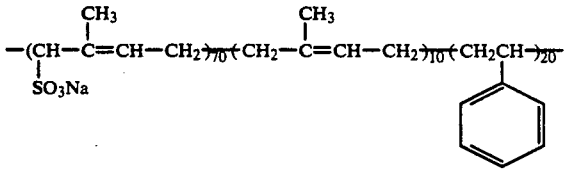

Mw = 40,000

Some of these compounds are commercially available as "JSR water-soluble polymers" from Japan Synthetic Rubber Co., Ltd.

The water-soluble polymer represented by formula I or formula II is contained in an amount of 5 mg to 5 g, preferably 10 mg to 2 g per $m^2$ of the photographic material.

Nonionic surfactant of the present invention represented by formula III, III' or III", are described below.

$R_1-A(CH_2CH_2O)_{n1}-H$ Formula [III]

Formula [III']

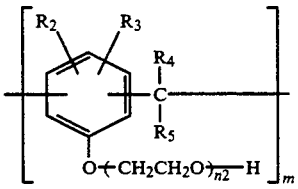

Formula [III"]

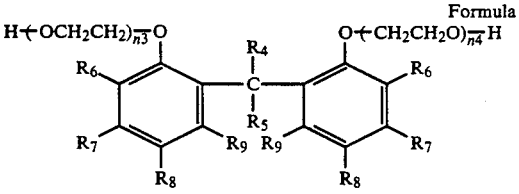

In these formulas, $R_1$ represents a substituted or unsubstituted alkyl group having 1 to 30 carbon atoms, an alkenyl group or an aryl group; A represents —O—, —S—, —COO—, $-\underset{|}{N}-R_{10}$, $-CO-\underset{|}{N}-R_{10}$ or $-SO_2N-R_{10}$, wherein $R_{10}$ represents a hydrogen atom or a substituted or unsubstituted alkyl group.

$R_2$, $R_3$, $R_7$ and $R_9$ independently represent a hydrogen atom, a substituted or unsubstituted alkyl group, an aryl group, an alkoxy group, a halogen atom, an acyl group, an amide group, a sulfonamide group, a carbamoyl group or a sulfamoyl group. $R_6$ and $R_8$ independently represent a substituted or unsubstituted alkyl group, an aryl group, an alkoxy group, a halogen atom, an acyl group, an amide group, a sulfonamide group, a carbamoyl group or a sulfamoyl group. With respect to formula III". $R_4$ and $R_5$ independently represent a hydrogen atom, a substituted or unsubstituted alkyl group, or an aryl group. $R_4$ and $R_5$, $R_6$ and $R_7$, and $R_8$ and $R_9$, may bind together to form a substituted or unsubstituted ring. $n_1$, $n_2$, $n_3$ and $n_4$ independently represent the degree of polymerization of ethylene oxide, ranging from 2 to 50, and m represents the degree of polymerization, ranging from 2 to 50.

Examples of preferable compounds of the present invention, represented by formula III, III' or III", are given below, which are not to be construed as limitative.

$C_{11}H_{33}COO(CH_2CH_2O)_{19}H$ III-1

$C_{17}H_{33}COO(CH_2CH_2O)_{16}H$ III-2

$C_{15}H_{31}COO(CH_2CH_2O)_{16}H$ III-3

$C_8H_{17}O(CH_2CH_2O)_{19}H$ III-4

$C_{12}H_{25}O(CH_2CH_2O)_{10}H$ III-5

$C_{16}H_{33}O(CH_2CH_2O)_{12}H$ III-6

$C_{18}H_{35}O(CH_2CH_2O)_{16}H$ III-7

III-8

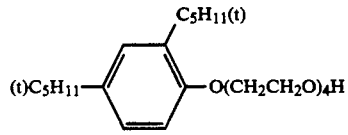

III-9

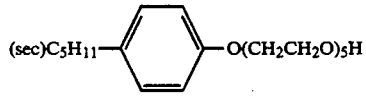

III-10

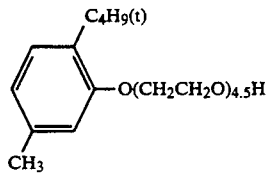

-continued

III-11

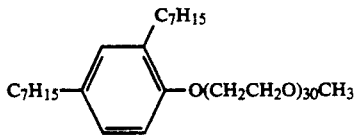

III-12

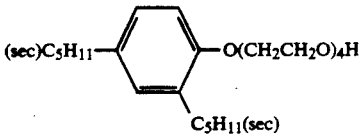

III-13

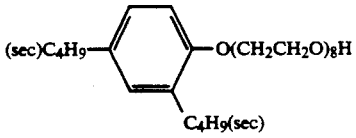

III-14

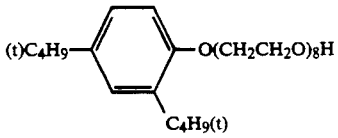

III-15

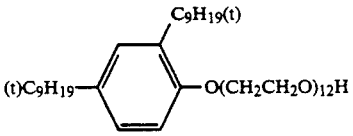

III-16

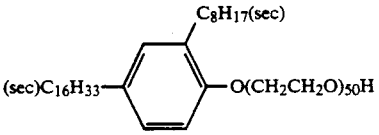

III-17

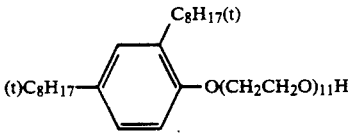

III-18

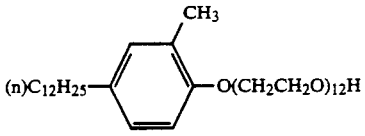

III-19

$C_{12}H_{25}S(CH_2CH_2O)_{15}H$

III-20

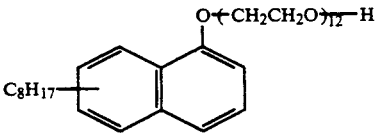

III-21

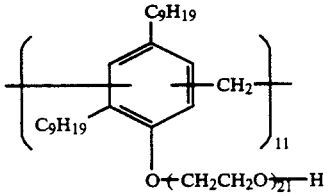

III-22

$C_{11}H_{23}CONH(CH_2CH_2O)_5H$

-continued

III-23

$C_{12}H_{25}NH(CH_2CH_2O)_{15}H$

III-24

$C_8H_{17}SO_2N(C_3H_7)(CH_2CH_2O)_{15}H$

Also included are exemplified Compound Nos. I-1 through I-7 described on page 2 of Japanese Patent O.P.I. Publication No. 55521/1977, and exemplified Compound Nos. I-15 through 18, I-20 and 21, I-24, I-29, I-34, I-44 and I-60 described on pages 5 through 8 of Japanese Patent O.P.I. Publication No. 76741/1985.

The above compounds can easily be synthesized by adding ethylene oxide to respective corresponding fatty acid monoethanolamides and carrying out a reaction therebetween. For example, Amizet 5C and Amizet 10C (both produced by Nikko Chemical) and other commercial products are categorized under this compound 4 and can be used in the present invention.

Although the amount of the surfactant used varies depending on the shape, kind and coating method of the photographic light-sensitive material used, it is preferable to use the surfactant in an amount of 1 to 1000 mg, particularly 5 to 200 mg per $m^2$ of photographic light-sensitive material. For introducing the surfactant to a layer of the photographic light-sensitive material, it is dissolved in water, an organic solvent such as methanol, ethanol or acetone, or a mixed solvent of water and an organic solvent as above, after which the solution is added to a light-sensitive emulsion layer or non light-sensitive auxiliary layer (e.g., anti-halation layer, interlayer, protective layer) on the support, or is sprayed or coated on the surface of the support, or the photographic light-sensitive material is immersed in said solution, followed by drying. In this operation, two or more kinds of nonionic and anionic surfactants may be used in combination.

To the emulsion layer or protective layer of the silver halide photographic material of the present invention, preferably to the protective layer, may be added a matting agent and/or lubricant.

As one preferred embodiment of the present invention, a silver halide photographic material contains a matting agent and the surface of the photographic material has a mattness of not more than 50 mmHg. The term "mattness" is expressed in smoothness of the surface, which is determined under a specific condition by measuring a suction force on an unprocessed photographic material which has been stored for three hours under 23° C. and 48% R.H. The larger the value is, the greater the mattness. The measurement of the suction force is carried out using a SMOOSTER (produced by Toei Denshi Kogyo K. K.), as described later.

The silver halide photographic light-sensitive material of the present invention is subjected to exposure and processing by using an automatic processing machine. A conventional developing solution can be used, as exemplified by that containing hydroquinone, 1-phenyl-3-pyrazolidone, N-methyl-p-aminophenol or p-phenylenediamine, which can be used alone or in combination thereof.

A developing solution containing an aldehyde hardening agent can be used in the silver halide photographic light-sensitive material of the invention. For example, a conventional developing solution containing dialdehyde such as maleic dialdehyde, or glutaraldehyde, and sodium bisulfites thereof can be used.

In the present invention, an overall processing time refers to the period of time through which the photographic material of the present invention is inserted to the first roller, which constitute the inlet of an automatic processing machine, and thereafter it passes through a developing tank, a fixing tank, and a drying tank until it reaches the last roller at a drying section outlet.

The overall processing time is 50 seconds or less, and preferably from 20 to 50 seconds. A processing time of less than 20 seconds may give rise to insufficient sensitivity, or bring about a dye residue or an image poor in uniformity.

The processing is carried out at a temperature of 60° C. or less, and preferably from 20° to 45° C.

An example of particulars of the overall processing time is shown below.

| Processing step | Temperature (°C.) | Time (sec) |
|---|---|---|
| Insertion | — | 1.2 |
| Developing + crossover | 35 | 14.6 |
| Fixing + crossover | 33 | 8.2 |
| Washing + crossover | 25 | 7.2 |
| Squeeze | 40 | 5.7 |
| Drying | 45 | 8.1 |
| Total | | 45.0 |

EXAMPLES

The present invention is hereinafter described in more detail by means of the following examples.

The present invention is by no means limited by these examples.

EXAMPLE 1

Preparation of Emulsion A

To 1 l of a solution containing 130 g of KBr, 2.5 g of K1, 30 mg of 1-phenyl-5-mercaptotetrazole and 15 g of gelatin being stirred at 40° C., 500 ml of a solution containing 0.5M ammoniacal silver nitrate was added in 1 minute. Two minutes later, acetic acid was added to obtain a pH of 6.0. One minute later, 500 ml of a solution containing 0.5M silver nitrate was added in 1 minute, followed by stirring for 15 minutes, after which a formalin condensate of naphthalene naphthalenesulfonate and an aqueous solution of magnesium sulfate were added to coagulate the emulsion. After supernatant removal, 2 l of 40° C. warm water was added, followed by stirring for 10 minutes, after which an aqueous solution of magnesium sulfate was added again to coagulate the emulsion. After supernatant removal, 300 ml of a 5% gelatin solution was added, followed by stirring at 55° C. for 30 minutes, to yield an emulsion.

This emulsion comprised grains having an average grain size of 0.27 μm wherein 90% of the total number of grains fell in the grain size range of 0.1 to 0.70 μm.

Preparation of Emulsion B

Using an AgBrI seed emulsion having an average grain size of 0.1 μ and an AgI content of 6 mol %, an aqueous solution of ammoniacal $AgNO_3$ and an aqueous solution of potassium bromide were added by the double jet method, and a monodispersed emulsion comprising cubic AgBrI grains having an average grain size of 0.25 μ and an average AgI content of 0.4 mol % was grown. The coefficient of variation ($\sigma/r$) was 0.17.

These emulsions A and B were each dissolved immediately before the start of chemical ripening. When the solution temperature became constant, a dye of the following formula 1 was added, and ammonium thiocyanate, chloroauric acid and hypo were added to cause chemical sensitization, and thereafter 4- hydroxy-5-methyl-1,3,3a,7-tetrazaindene was added thereto.

Dye (1)

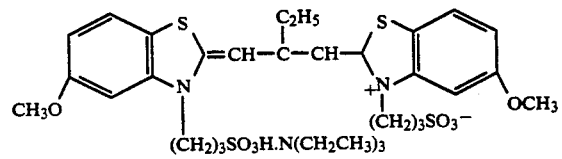

Coating Application of Red-sensitive Emulsions A and B Backing and Protective Layers A backing-coated support was prepared as follows: First, a backing layer coating solution, comprising a dye emulsion dispersion comprising 400 g of gelatin, 2 g of polymethyl methacrylate having an average grain size of 6 μm, 24 g of $KNO_3$, 6 g of sodium dodecylbenzenesulfonate and 20 g of the following anti-halation dye 1, in an amount equivalent to 2 g/m$^2$, and glyoxal, was prepared. Separately, an aqueous terpolymer dispersion was prepared by diluting to a 10% by weight of a terpolymer comprising 50% by weight glycidyl methacrylate, 10% by weight methyl acrylate and 40% by weight butyl methacrylate, and this dispersion, as a subbing solution, was coated on a polyethylene terephthalate base. On one face of the polyethylene terephthalate base, the above backing layer coating solution, along with a protective layer coating solution comprising gelatin, a matting agent, glyoxal, and sodium dodecylbenzenesulfonate, was coated, to yield a support having a backing layer.

The coating weight was 2.0 g/m$^2$, based on the amount of gelatin applied, for each of the backing and protective layers.

Anti-halation dye 1

-continued

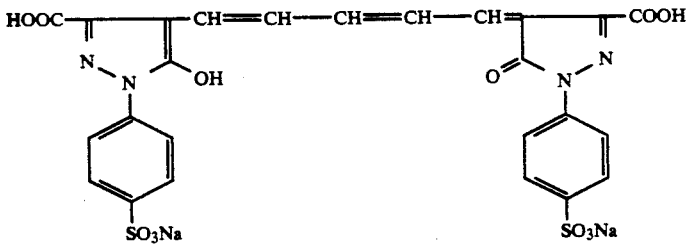

Preparation of Red-sensitive Photographic Sample Nos. 1–14, 17–43, and 45

Red-sensitive Silver Halide Emulsion Layer Coating Solution

To emulsion A or B were added 10 g (per mol of silver halide, the same applies below) of trimethylolpropane, 50 mg of nitrophenyl triphenylphosphonium chloride, 1 g of ammonium 1,3-dihydroxybenzene-4-sulfonate, 10 mg of sodium 2-mercaptobenzimidazole-5-sulfonate, 1 g of $C_4H_9OCH_2CH(OH)CH_2N(CH_2COOH)_2$, 10 mg of 1,1-dimethylol-1-bromo-1-nitromethane,

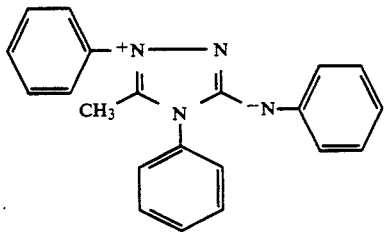

100 mg

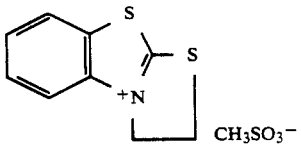

35 mg and others were added to provide a red-sensitive silver halide emulsion coating solution.

Emulsion-side Protective Layer Coating Solution

The composition is as follows: Figures for the amount of addition are per liter of coating solution.

| | |
|---|---|
| Limed inert gelatin | 68 g |
| Acid-treated gelatin | 2 g |
| $NaO_3S-CH(CH_2COOC_{10}H_{21})-COOC_5H_{11}$ (coating aid) | 1 g |

Polymethyl methacrylate grains having an average size of 4 μm were added to provide a degree of matting shown in Table 1.

| | |
|---|---|
| Silicon dioxide grains (1.2 μm area-averaged grain size, matting agent) | 0.5 g |
| Ludox AM (colloidal silica, produced by Du Pont) | 30 g |
| 2% aqueous solution of 2,4-dichloro-6-hydroxy-1,3,5-triazine sodium (hardener) | 10 ml |
| 35% formalin (hardener) | 2 ml |
| 40% aqueous solution of glyoxal (hardener) | 1.5 ml |

-continued

| | |
|---|---|
| 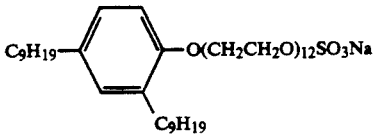 | 1.0 g |
| $CH_2COO(CH_2)_9CH_3$ / $CHCOO(CH_2)_2CH(CH_3)_2$ / $SO_3Na$ | 0.3 g |
| $NaO_3S-CH(CH_2COOCH_2(C_2F_4)_3H)-COOCH_2(C_2F_4)_3H$ | 0.5 g |
| $C_4F_9SO_3K$ | 2 mg |
| Topcide 300 (produced by Permachem Asia Ltd.) | 45 mg |
| Nonionic surfactants of formulas IIIa–IIIc (added to all samples but sample No. 1) | |
| Example compound III-15 | 0.4 g |
| Example compound III-22 | 2.5 g |

On the side opposite to the backing coated side, the silver halide emulsion layer coating solution and protective layer coating solution were simultaneously coated in this sequence from the support by the slide hopper method at a coating speed of 80 m/min, to yield a red-sensitive photographic sample. The coating weight of silver was 2.5 g/m$^2$, and the coating weight of gelatin was 2.2 g/m$^2$ for the emulsion layer and 1.2 g/m$^2$ for the protective layer.

As shown in Table 1, a water-soluble polymer of formulas I or II was added to the emulsion layer or protective layer.

Preparation of Emulsion C

1) Preparation of Seed Emulsion

To a 0.05N aqueous potassium bromide solution containing gelatin treated with hydrogen peroxide, being stirred vigorously at 40° C., an aqueous silver nitrate solution and an equal molar amount of an aqueous potassium bromide solution containing gelatin treated with hydrogen peroxide were added by the double jet method. 1.5 minutes later, the liquid temperature was decreased to 25° C. over a 30-minute period, after which 80 ml of aqueous ammonia (28%) was added per mol of silver nitrate, and the mixture was stirred for 5 minutes. After addition of acetic acid to obtain a pH of 6.0, the resulting reaction mixture was desalinized using an aqueous solution of Demol-Na (produced by Kao Atlas) and an aqueous solution of magnesium sulfate, after which it was re-dispersed in an aqueous gelatin solution, to yield a seed emulsion comprising spherical grains having an average grain size of 0.23 μm and a coefficient of variation of 0.28.

2) Grain Growth From Seed Emulsion

Using the above seed emulsion, grains were grown as follows: To an aqueous solution containing ossein gelatin and disodium salt of propyleneoxy-polyethyleneoxy disuccinate being stirred vigorously at 75° C., an aqueous solution of potassium bromide and potassium iodide and an aqueous solution of silver nitrate were added by the double jet method, while maintaining a pH of 5.8 and a pAg of 9.0. After completion of the addition, pH was adjusted to 6.0, and 400 mg/mol AgX of an anhydride of sodium salt of 5,5'-dichloro-9-ethyl-3,3'-di-(3-sulfopropyl)oxacarbocyanine was added. This mixture was further desalinized at 40° C., using an aqueous solution of Demol-Na (produced by Kao Atlas) and an aqueous solution of magnesium sulfate, after which it was re-dispersed in an aqueous gelatin solution.

A tabular silver iodobromide emulsion (emulsion C) having an average silver iodide content of 1.5 mol %, a projected area diameter of 0.96 μm, a coefficient of variation of 0.25 and an aspect ratio (projected area diameter/grain thickness) of 4.0 was thus obtained.

Preparation of Green Sensitive Sample Nos. 13, 14, 34 and 35

To the resulting emulsion C, an anhydride of sodium salt of 5,5'-dichloro-9-ethyl-3,3'-di-(3-sulfopropyl)oxacarbocyanine and an anhydrous sodium salt of 5,5'di-(butoxycarbonyl)-1,1'-diethyl-3,3'-di-(4-sulfobutyl)benzimidazolocarbocyanine, in a weight ratio of 200:1, were added at 500 mg per mol of silver halide at 50° C.

Ten minutes later, appropriate amounts of chloroauric acid, sodium thiosulfate and ammonium thiocyanate were added to cause chemical ripening. 15 minutes before completion of the ripening, potassium iodide was added at 200 mg per mol of silver halide, after which 4-hydroxy-6-methyl-1,3,3a,7-tetrazaindene was added at $3\times10^{-2}$ mol per mol of silver halide, and this mixture was dispersed in an aqueous solution of 70 g of gelatin. To ripened emulsion C, the following additives were added. The amount of addition are per mol of silver halide.

| | |
|---|---|
| 1,1-dimethylol-1-bromo-1-nitromethane | 70 mg |
| t-butylcatechol | 400 mg |
| Polyvinylpyrrolidone (molecular weight 10,000) | 1.0 g |
| Styrene-maleic anhydride copolymer | 2.5 g |
| Nitrophenyl-triphenylphosphonium chloride | 50 mg |
| Ammonium 1,3-dihydroxybenzene-4-sulfonate | 4 g |
| Sodium 2-mercaptobenzimidazole-5-sulfonate | 15 mg |
| 1-phenyl-5-mercaptotetrazole | 10 mg |
| Trimethylolpropane | 10 g |
| $C_4H_9OCH_2CH(OH)CH_2N(CH_2COOH)_2$ | 1 g |
| 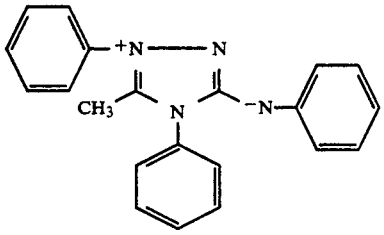 | 60 mg |

-continued

| | |
|---|---|
| 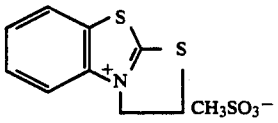 | 35 mg |

1.2 g of the following dye emulsion dispersion was added to yield a coating emulsion.

Preparation of Dye Emulsion Dispersion 10 kg of the following dye was dissolved in a mixed solvent of 28 l of tricresyl phosphate and 85 l of ethyl acetate at 55° C. This solution is designated as oily solution. Separately, 270 l of a 9.3% aqueous solution of gelatin containing 1.35 kg of anionic surfactant AS was prepared. This solution is designated as aqueous solution. Next, the oily solution and the aqueous solution were placed in a dispersing vessel and dispersed while keeping the liquid temperature at 40° C. To the resulting dispersion were added appropriate amounts of phenol and 1,1-dimethylol-1-bromo-1-nitromethane, and water was added to make 240 kg.

Dye

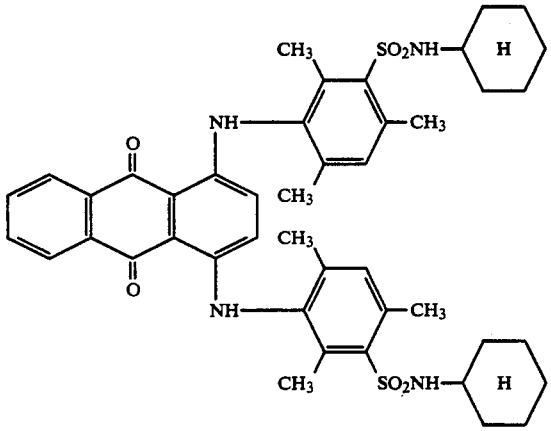

AS

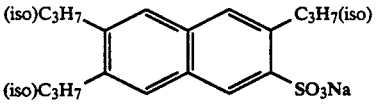

The additives used in the protective layer on the emulsion surface side are as follows: The amount of addition are per liter of coating solution.

| | |
|---|---|
| Limed inert gelatin | 68 g |
| Acid-treated gelatin | 2 g |
| Sodium isoamyl-n-decylsulfosuccinate | 0.3 g |

Polymethyl methacrylate (matting agent of area-average grain size of 4 μm) Added to obtain a degree of matting shown in Table 1

| | |
|---|---|
| Silicon dioxide grains (matting agent of area-average grain size 1.2 μm) | 0.5 g |
| Ludox AM (colloidal silica, produced by Du Pont) | 30 g |

-continued

| | |
|---|---|
| 40% aqueous solution of glyoxal (hardener) | 1.5 ml |
| $(CH_2{=}CHSO_2CH_2)_2O$ (hardener) | 500 mg |
| Topcide 300 (produced by Permachem Asia Ltd.) | 45 mg |
| 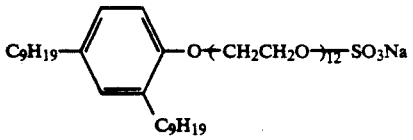 | 1.0 g |
| 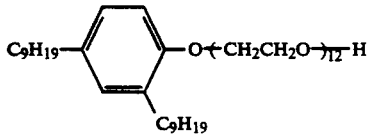 | 0.4 g |
| $NaO_3S{-}CH(CH_2COOCH_2(C_2F_4)_3H)COOCH_2(C_2F_4)_3H$ | 0.5 g |
| Nonionic surfactants (formulas IIIa through IIIc) | |
| III-15 | 0.4 g |
| III-22 | 2.5 g |

Using two slide hopper coaters, a 175 μm polyethylene terephthalate film base, coated with an aqueous dispersion of a terpolymer comprising 50% by weight glycidyl methacrylate, 10% by weight methyl acrylate and 40% by weight butyl methacrylate, diluted to a concentration of 10% by weight, was coated with an emulsion layer and protective layer on one face and with upper and lower backing layers on the opposite face simultaneously at a coating speed of 90 m/min and dried in 2 minutes and 15 seconds, to yield green-sensitive sample Nos. 15, 16 and 44, wherein the coating weight of silver was 2.9 g/m² for the emulsion layer and that of gelatin was 1.1 g/m² for the protective layer.

The compositions of the backing layer solutions are given below. A water-soluble polymer was added as shown in Table 1.

Backing Layer Coating Solution Compositions

Two backing layers, i.e., the upper and lower backing layers, were coated, in a coating weight of gelatin of 1.2 g/m² for the upper layer and 3.0 g/m² for the lower layer.

The backing layer coating solutions were prepared as follows:

| Backing layers | |
|---|---|
| Lower layer coating solution (per liter of coating solution) | |
| Limed gelatin | 70 g |
| Acid-treated gelatin | 5 g |
| Trimethylolpropane | 1.5 g |
| Backing dye A | 1.0 g |
| Backing dye B | 1.0 g |
| Aqueous glyoxal solution (40%) (hardener) | 8 g |
| Upper layer coating solution (per liter of coating solution) | |
| Limed gelatin | 70 g |
| Acid-treated gelatin | 5 g |
| Trimethylolpropane | 1.5 g |
| Backing dye A | 1.0 g |
| Backing dye C | 1.0 g |
| $KNO_3$ | 0.5 g |

-continued

| Backing layers | |
|---|---|
| 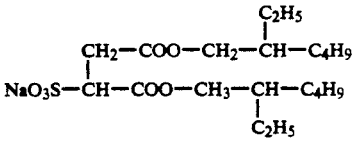 | 0.4 g |
| $NaO_3S{-}CH(CH_2COOCH_2(C_2F_4)_3H)COOCH_2(C_2F_4)_3H$ | 0.3 g |
| 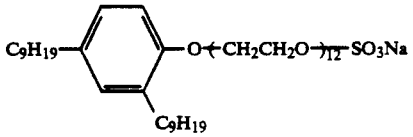 | 1.0 g |
| $F_{19}C_{90}(CH_2CH_2O)_{10}CH_2CH_2{-}SO_3Na$ | 0.1 g |
| 2% aqueous solution of sodium salt of 2,4-dichloro-6-hydroxy-1,3,5-triazine | 20 ml |
| Polymethyl methacrylate grains of an area-average grain size of 6 μm | 1.1 g |
| $C_{11}H_{23}CONH(CH_2CH_2O)_5H$ | 1.0 g |
| Backing dye A | |
| 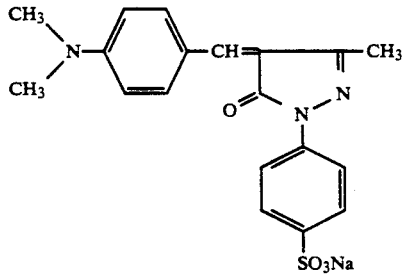 | |
| Backing dye B | |
| 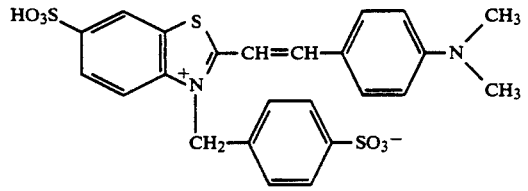 | |
| Backing dye C | |
| 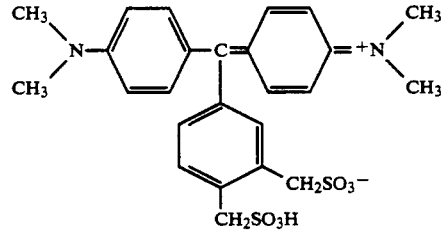 | |

Evaluation of the Mattness

The mattness is evaluated with the aid of SMOOSTER(produced by Toei Denshi Kogyo K. K.). Thus, utilizing a vacuum type air micrometer, an inflow rate of air variable depending upon smoothness of the surface is measured as a change of pressure. The mattness is defined as a pressure value expressed in mmHg. The larger is the value, the greater the mattness. When measuring the mattness, a test sample which has been stored for three hours under 23° C. and 48% R.H., is placed beneath a head as shown in FIG. 1. When a vacuum pump sucks out air inside a tube, the pressure inside the tube (P) is read off.

Evaluation of Antistatic Property (Static Marks)

To evaluate the antistatic property of each obtained sample, static marks were evaluated as follows: Sample Nos. 1 through 45 were kept standing in an atmosphere

TABLE 1

| No. | Emulsion | Water-soluble polymer | Site of addition | Coating weight (mg/m$^2$) | Degree of matting (mmHg) | Nonionic surfactant III-15, III-22 | Total processing time | Devel-oper | Remark |
|---|---|---|---|---|---|---|---|---|---|
| 1 | B | — | — | — | 30 | Not added | 45 seconds | H | Comparative |
| 2 | B | — | — | — | 100 | Added | 45 seconds | H | Comparative |
| 3 | B | — | — | — | 50 | Added | 45 seconds | H | Comparative |
| 4 | B | — | — | — | 30 | Added | 45 seconds | H | Comparative |
| 5 | B | — | — | — | 30 | Added | 90 seconds | H | Comparative |
| 6 | B | I-2 | Emulsion side protective layer | 5 | 30 | Added | 45 seconds | H | Inventive |
| 7 | B | I-2 | Emulsion side protective layer | 10 | 30 | Added | 45 seconds | H | Inventive |
| 8 | B | I-2 | Emulsion side protective layer | 50 | 100 | Added | 45 seconds | H | Inventive |
| 9 | B | I-2 | Emulsion side protective layer | 50 | 50 | Added | 45 seconds | H | Inventive |
| 10 | B | I-2 | Emulsion side protective layer | 50 | 30 | Added | 45 seconds | H | Inventive |
| 11 | B | I-2 | Emulsion side protective layer | 200 | 30 | Added | 45 seconds | H | Inventive |
| 12 | B | I-2 | Emulsion side protective layer | 250 | 30 | Added | 45 seconds | H | Inventive |
| 13 | A | I-2 | Emulsion side protective layer | 10 | 30 | Added | 45 seconds | H | Inventive |
| 14 | A | I-2 | Emulsion side protective layer | 50 | 30 | Added | 45 seconds | H | Inventive |
| 15 | C | I-2 | Emulsion side protective layer | 10 | 30 | Added | 45 seconds | H | Inventive |
| 16 | C | I-2 | Emulsion side protective layer | 50 | 30 | Added | 45 seconds | H | Inventive |
| 17 | B | I-3 | Emulsion side protective layer | 10 | 30 | Added | 45 seconds | H | Inventive |
| 18 | B | I-3 | Emulsion side protective layer | 50 | 30 | Added | 45 seconds | H | Inventive |
| 19 | B | I-5 | Emulsion side protective layer | 10 | 30 | Added | 45 seconds | H | Inventive |
| 20 | B | I-5 | Emulsion side protective layer | 50 | 30 | Added | 45 seconds | H | Inventive |
| 21 | B | I-6 | Emulsion side protective layer | 50 | 30 | Added | 45 seconds | H | Inventive |
| 22 | B | I-12 | Emulsion side protective layer | 10 | 30 | Added | 45 seconds | H | Inventive |
| 23 | B | I-12 | Emulsion side protective layer | 200 | 30 | Added | 45 seconds | H | Inventive |
| 24 | B | I-13 | Emulsion side protective layer | 50 | 30 | Added | 45 seconds | H | Inventive |
| 25 | B | I-16 | Emulsion side protective layer | 50 | 30 | Added | 45 seconds | H | Inventive |
| 26 | B | II-1 | Emulsion side protective layer | 10 | 30 | Added | 45 seconds | H | Inventive |
| 27 | B | II-1 | Emulsion side protective layer | 50 | 30 | Added | 45 seconds | H | Inventive |
| 28 | B | II-2 | Emulsion side protective layer | 50 | 30 | Added | 45 seconds | H | Inventive |
| 29 | B | II-3 | Emulsion side protective layer | 50 | 30 | Added | 45 seconds | H | Inventive |
| 30 | B | II-5 | Emulsion side protective layer | 50 | 30 | Added | 45 seconds | H | Inventive |
| 31 | B | I-2 | Emulsion layer | 10 | 30 | Added | 45 seconds | H | Inventive |
| 32 | B | I-2 | Emulsion layer | 200 | 30 | Added | 45 seconds | H | Inventive |
| 33 | B | I-5 | Emulsion layer | 10 | 30 | Added | 45 seconds | H | Inventive |
| 34 | B | I-5 | Emulsion layer | 200 | 30 | Added | 45 seconds | H | Inventive |
| 35 | B | I-5 | Emulsion layer | 50 | 100 | Added | 45 seconds | H | Inventive |
| 36 | B | I-5 | Emulsion layer | 50 | 50 | Added | 45 seconds | H | Inventive |
| 37 | B | I-5 | Emulsion layer | 50 | 30 | Added | 45 seconds | H | Inventive |
| 38 | B | I-5 | Emulsion layer | 200 | 30 | Added | 45 seconds | K | Inventive |
| 39 | B | I-2 | Emulsion layer | 10 | 30 | Added | 45 seconds | K | Inventive |
| 40 | B | I-2 | Emulsion layer | 200 | 30 | Added | 45 seconds | K | Inventive |
| 41 | B | II-1 | Emulsion layer | 10 | 30 | Added | 45 seconds | K | Inventive |
| 42 | B | II-1 | Emulsion layer | 200 | 30 | Added | 45 seconds | K | Inventive |
| 43 | A | — | Emulsion layer | — | 30 | Added | 45 seconds | H | Comparative |
| 44 | C | — | Emulsion layer | — | 30 | Added | 45 seconds | H | Comparative |
| 45 | B | I-5 | Emulsion layer | 100 | 30 | Added | 45 seconds | H | Inventive |
| | | I-12 | Protective layer | 100 | | | | | |

of 20% RH for 1 hour, after which they were cut into 6×30 cm pieces. As illustrated in FIG. 1 a 500 gram weight 13 was suspended on each piece 12 which was subjected to friction with neoprene rubber rod 10 of about 30 mm diameter at a speed of one reciprocal cycle per about 0.8 seconds in the direction indicated by arrow in a total of five cycles. Then, the piece, remaining unexposed, was processed using the Konica X-ray automatic processing machine SRX-501, and macroscopically observed for static marks. The antistatic property was evaluated in accordance with the following criteria. The results are given in Table 2.

Evaluation Criteria

A: Very good
B: Good
C: No problem for practical use
D: Poor

Evaluation of Uneven Development

Sample Nos. 1 through 45 were subjected to uniform exposure to tungsten light to a density of 1.1±0.1 and then subjected to the following developing and other processes, after which they were macroscopically evaluated for uneven development. The results are given in Table 2.

Evaluation Criteria

A: Very good
B: Good
C: No problem for practical use
D: Poor
E: Very poor

TABLE 2

| No. | Anti-static property | Uneven develop-ment | Remark | No. | Anti-static property | Uneven develop-ment | Remark |
|---|---|---|---|---|---|---|---|
| 1 | D | C | Comparative | 24 | A | A | Inventive |
| 2 | A | E | Comparative | 25 | A | A | Inventive |
| 3 | A | E | Comparative | 26 | A | B | Inventive |
| 4 | A | E | Comparative | 27 | A | A | Inventive |
| 5 | A | D | Comparative | 28 | A | A | Inventive |
| 6 | A | C | Inventive | 29 | A | A | Inventive |
| 7 | A | B | Inventive | 30 | A | A | Inventive |
| 8 | A | C | Inventive | 31 | A | B | Inventive |
| 9 | A | B | Inventive | 32 | A | A | Inventive |
| 10 | A | A | Inventive | 33 | A | B | Inventive |
| 11 | A | A | Inventive | 34 | A | A | Inventive |
| 12 | A | A | Inventive | 35 | A | C | Inventive |
| 13 | A | B | Inventive | 36 | A | B | Inventive |
| 14 | A | A | Inventive | 37 | A | A | Inventive |
| 15 | A | B | Inventive | 38 | A | A | Inventive |
| 16 | A | A | Inventive | 39 | A | B | Inventive |
| 17 | A | B | Inventive | 40 | A | A | Inventive |
| 18 | A | A | Inventive | 41 | A | B | Inventive |
| 19 | A | B | Inventive | 42 | A | A | Inventive |
| 20 | A | A | Inventive | 43 | A | E | Comparative |
| 21 | A | A | Inventive | 44 | A | E | Comparative |
| 22 | A | B | Inventive | 45 | A | A | Inventive |
| 23 | A | A | Inventive | — | — | — | — |

From the results given in Table 2, it is seen that the samples prepared in accordance with the present invention are excellent in antistatic property and prevention of uneven development.

Developing and Other Processes

Developing was achieved using the following developers and fixer, using the automatic processing machine SRX-501 (produced by Konica Corporation) at a developing temperature of 35° C. and a fixing temperature of 33° C. Washing water at 18° C. was supplied at a flow rate of 3.5 l per minute. Drying temperature was 45° C. The whole processing was performed over a period of time of 45 seconds in total, as shown in Table 1.

| Processing procedures | | | |
|---|---|---|---|
| Procedure | Processing temperature (°C.) | Processing time (seconds) | Replenishing rate |
| Feed | — | 1.2 | |
| Developing + transition | 35 | 14.6 | 33 cc/10 × 12 inch size |
| Fixing + transition | 33 | 8.2 | 63 cc/10 × 12 inch size |
| Washing + transition | 18 | 7.2 | 3.5 l/min |
| Squeezing | 40 | 5.7 | — |
| Drying | 45 | 8.1 | — |
| Total | — | 45.0 | — |

Developer H

| | |
|---|---|
| Potassium sulfite | 70 g |
| Trisodium hydroxyethylehtylenediaminetriacetate | 8 g |
| 1,4-dihydroxybenzene | 28 g |
| Boric acid | 10 g |
| 5-methylbenzotriazole | 0.04 g |
| 1-phenyl-5-mercaptotetrazole | 0.01 g |
| Sodium metabisulfite | 5 g |
| Acetic acid (90%) | 13 g |
| Triethylene glycol | 15 g |
| 1-phenyl-3-pyrazolidone | 1.2 g |
| 5-nitroindazole | 0.2 g |
| Glutaraldehyde | 4 g |
| Potassium bromide | 4 g |
| 5-nitrobenzimidazole | 1 g |

Water was added to 1 l, and sodium hydroxide was added to obtain a pH of 10.5.

Fixer

| | |
|---|---|
| Sodium thiosulfate pentahydrate | 4.5 g |
| Disodium ethylenediaminetetraacetate | 0.5 g |
| Ammonium thiosulfate | 150 g |
| Anhydrous sodium sulfite | 8 g |
| Potassium acetate | 16 g |
| Aluminum sulfate 10–18 hydrate | 10 g |
| Sulfuric acid (50 wt %) | 5 g |
| Citric acid | 1 g |
| Boric acid | 7 g |
| Glacial acetic acid | 5 g |

Water was added to 1 l, and glacial acetic acid was added to obtain a pH of 4.2.

Developer K

-continued

| |
|---|
| The same composition as developer H but glutatraldehyde was eliminated. |

What is claimed is:

1. A silver halide photographic light-sensitive material comprising a support having on one side thereof hydrophilic colloidal layers including a silver halide emulsion layer, which is exposed and processed with an automatic processing machine, wherein at least one of the hydrophilic layers contains a water-soluble polymer represented by formula [I] or a water-soluble polymer having a repeating unit represented by formula [II], and a nonionic surfactant represented by formula [IIIa], [IIIb] or [IIIc]

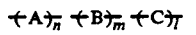

formula [I]

wherein A is a repeating unit represented by the following formula [A]; B and C each represent a repeating unit comprising a vinyl monomer copolymerizable with A; n is 10 to 100 mol % per polymer molecule and m+l is 0 to 90 mol % per polymer molecule,

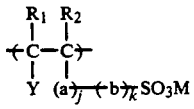

formula [A]

wherein $R_1$ and $R_2$ each represent a hydrogen atom, an alkyl group, a halogen atom or —$CH_2COOM$, in which M represents a hydrogen atom, an alkali metal atom, an alkaline earth metal atom, or substituted or unsubstituted ammonium group; a represents —CONH—, —NHCO—, —COO—, —OCO—, —CO—, $SO_2$—, —$NHSO_2$—, —$SO_2NH$— or —O—; b represents an alkylene group, an arylene group or aralkylene group; j represents 0 or 1; k represents an integer of 1 to 10; Y represents a hydrogen atom or —$(a)_j$—$(b)_k$—$SO_3M$,

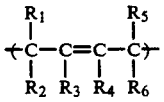

formula [II]

wherein $R_1$ through $R_6$ independently represent a hydrogen atom, an alkyl group having 1 to 6 carbon atoms, an aryl group having 6 to 20 carbon atoms or —$SO_3X$, where X represents a hydrogen atom, an alkali metal atom, an alkaline earth metal atom, or substituted or unsubstituted ammonium group,

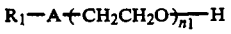

formula [IIIa]

formula [IIIb]

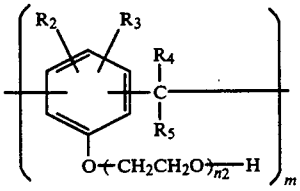

-continued formula [IIIc]

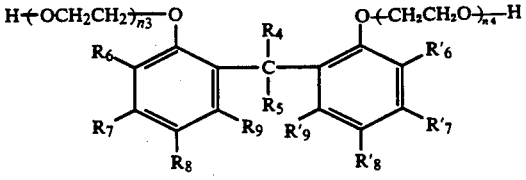

wherein $R_1$ represents an alkyl group, an alkenyl group or an aryl group ; A represents —O—, —S—, —COO—, —N—$R_{10}$, —CO—N—$R_{10}$ or —$SO_2$-N—$R_{10}$, where $R_{10}$ represents a hydrogen atom or an alkyl group; $R_2$, $R_3$, $R_7$, $R'_7$, $R_9$ or $R'_9$ independently represent a hydrogen atom, an alkyl group, an aryl group, an alkoxy group, a halogen atom, an acyl group, an amide group, a sulfonamide group, a carbamoyl group or a sulfamoyl group; $R_4$ and $R_5$ independently represent a hydrogen atom, an alkyl group or an aryl group; $R_6$, $R'_6$, $R_8$ and $R'_8$ independently represent an alkyl group, an aryl group, an alkoxy group a halogen atom, an acyl group, an amide group, a sulfonamide group, a carbamoyl group or a sulfamoyl group; $n_1$, $n_2$, $n_3$ and $n_4$ independently an integer of 2 to 50; m represents an integer of 2 to 50.

2. The silver halide photographic material of claim 1, wherein said water-soluble polymer represented by formula [I] or said water-soluble polymer having a repeating unit represented by formula [II] is contained in an amount of 5 mg to 5 g per $m^2$ of the photographic material.

3. The silver halide photographic material of claim 1, wherein said nonionic surfactant is contained in an amount of 1 to 1000 mg per $m^2$ of the photographic material.

4. The silver halide photographic material of claim 1, wherein the surface of said hydrophilic colloidal layers has a mattness of not more than 50 mmHg.

5. The silver halide photographic material of claim 1, wherein said exposed photographic material is processed with an automatic processing machine for an overall processing time of not 50 seconds or less.

6. The silver halide photographic material of claim 1, wherein said water-soluble polymer is a polymer of formula [I].

7. The silver halide material of claim 6, wherein said water-soluble polymer has a number average molecular weight ($\overline{M}_n$) of 500 to 5,000,000.

8. The silver halide material of claim 7, wherein the water-soluble polymer is selected from the group consisting of

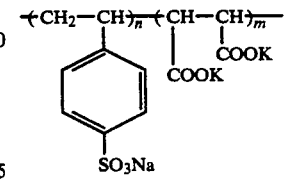

I-1 n:m = 50:50

$\overline{M}_n \approx 120,000$

-continued

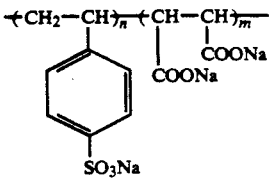

n:m = 70:30
$\overline{M}_n \approx 5{,}000$

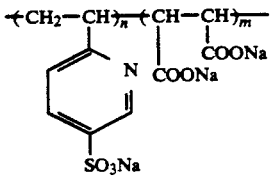

n:m = 80:20
$\overline{M}_n \approx 10{,}000$

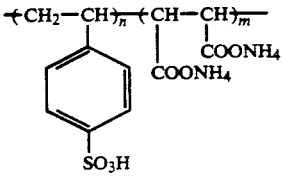

n:m = 20:80
$\overline{M}_n \approx 30{,}000$

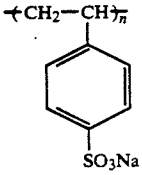

$\overline{M}_n \approx 50{,}000$

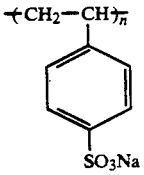

$\overline{M}_n \approx 5{,}000$

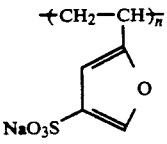

$\overline{M}_n \approx 200{,}000$

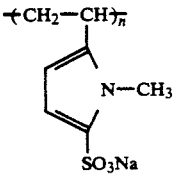

$\overline{M}_n \approx 200{,}000$

-continued

I-2

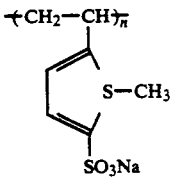

$\overline{M}_n \approx 150{,}000$

I-3

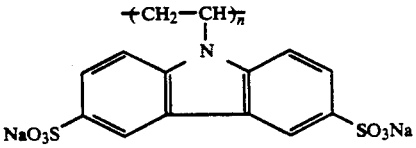

$\overline{M}_n \approx 300{,}000$

I-4

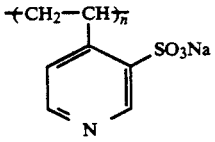

$\overline{M}_n \approx 280{,}000$

I-5

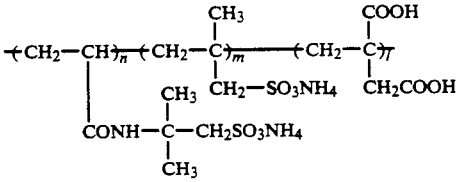

n:m:l = 75:5:20
$\overline{M}_n \approx 5{,}000$

I-6

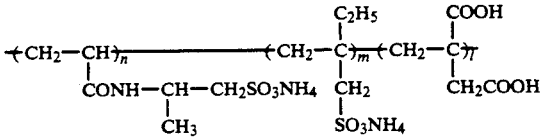

n:m:l = 75:5:20
$\overline{M}_n \approx 50{,}000$

I-7

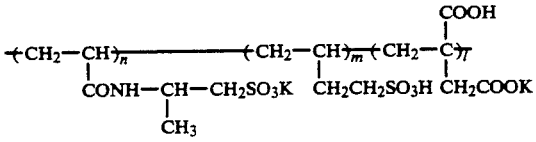

n:m:l = 50:5:45
$\overline{M}_n \approx 120{,}000$

I-8

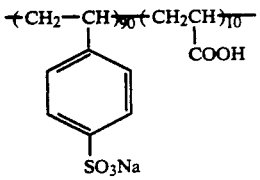

$\overline{M}_n = 10{,}000$

I-9

I-10

I-11

I-12

I-13

I-14

I-15

-continued
I-16
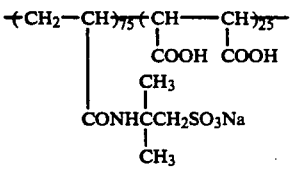
$\overline{M}_n$ = 6,000
I-17
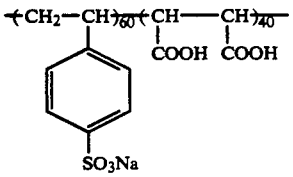
$\overline{M}_n$ = 6,000
I-18
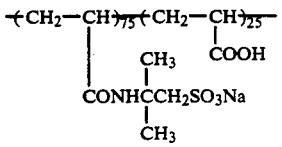
$\overline{M}_n$ = 6,000
I-19
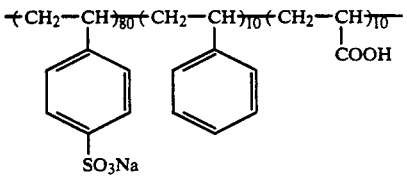
$\overline{M}_n$ = 15,000
I-20
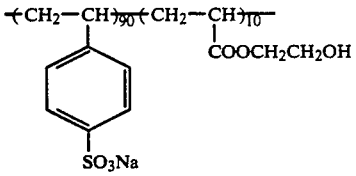
$\overline{M}_n$ = 10,000
-continued
I-21
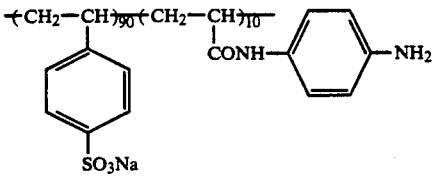
$\overline{M}_n$ = 15,000
I-22
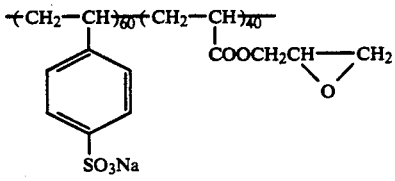
$\overline{M}_n$ = 6,000
I-23
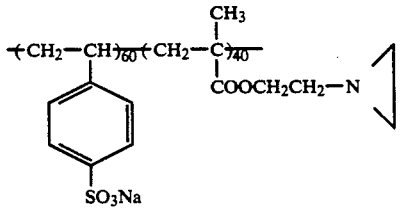
$\overline{M}_n$ = 8,000
I-24
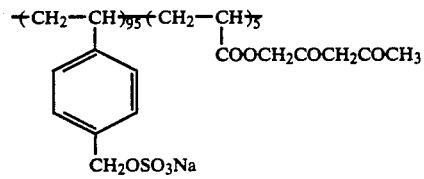
$\overline{M}_n$ = 25,000
and
I-25
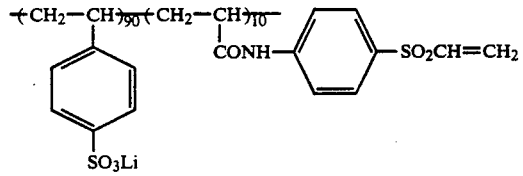
$\overline{M}_n$ = 6,000
9. The silver halide photographic light-sensitive material of claim 8, wherein the water-soluble polymer is the polymer of formula I-2.
* * * * *